United States Patent [19]

Nagata et al.

[11] Patent Number: 4,727,725

[45] Date of Patent: Mar. 1, 1988

[54] GAS INJECTION SYSTEM FOR SCREW COMPRESSOR

[75] Inventors: Kimio Nagata; Shigekazu Nozawa, both of Shimizu, Japan

[73] Assignee: Hitachi, Ltd., Tokyo, Japan

[21] Appl. No.: 863,245

[22] Filed: May 14, 1986

[30] Foreign Application Priority Data

May 20, 1985 [JP] Japan ..... 60-105804

[51] Int. Cl.[4] ..... F25B 41/04; F04C 18/16; F04C 29/08; F04B 49/02

[52] U.S. Cl. ..... 62/196.3; 62/513; 418/15; 418/100; 418/201; 417/310

[58] Field of Search ..... 418/15, 159, 180, 201-203, 418/100; 62/196.3, 228.5, 513; 417/310, 440

[56] References Cited

U.S. PATENT DOCUMENTS 4,005,949 2/1977 Grant ..... 418/15
4,062,199 12/1977 Kasahara et al. ..... 418/201

FOREIGN PATENT DOCUMENTS 2648609 5/1978 Fed. Rep. of Germany .
1566954 5/1969 France .
59-119084 7/1984 Japan ..... 418/201

*Primary Examiner*—John J. Vrablik
*Attorney, Agent, or Firm*—Antonelli, Terry & Wands

[57] ABSTRACT

A refrigerant gas injection system for a refrigeration cycle of the type having a screw compressor provided with a slide valve for controlling the compression capacity of the screw compressor, an economizer disposed in a passage for refrigerant liquid and adapted for subcooling the refrigerant liquid by the refrigerant of a reduced pressure, and a refrigerant gas injection line through which the refrigerant gas generated in the economizer is injected into the compression chamber of the screw compressor in its compression phase. The refrigerant gas injection system has a gas injection controller adapted to enable the injection of the refrigerant gas when the screw compressor is operating at full (100%) capacity or load level and to prevent the injection of the refrigerant gas when the screw compressor is operating in unloaded state.

5 Claims, 4 Drawing Figures

GAS INJECTION SYSTEM FOR SCREW COMPRESSOR

BACKGROUND OF THE INVENTION

The present invention relates to a gas injection system for injecting a refrigerant gas into the compression process of a screw compressor of a refrigeration cycle for the purpose of eliminating reduction in the refrigeration power, and more particularly in a so-called economizer cycle which employs a subcooling device for subcooling a liquid refrigerant.

A known refrigeration system employing the abovementioned economizer cycle incorporates a screw compressor having a capacity controlling or unloading means constituted by a slide valve. In such a refrigeration system, the refrigerant gas which has subcooled the refrigerant liquid in the subcooling device is injected into the compression chamber of a screw compressor in the compression phase so as to avoid any reduction in the refrigeration power.

Such a gas injection system for injecting refrigerant gas into a screw compressor is proposed in, for example, U.S. Pat. No. 4,005,949. This proposed gas injection system, however, suffers from a disadvantage in that the injected refrigerant gas is undesirably introduced into the suction side of the screw compressor, if the gas injection is performed when the screw compressor is operating in the unloaded state with its slide valve opened thereby adversely affecting the merit of the refrigerant gas injection and causing various unfavourable effects.

SUMMARY OF THE INVENTION

Accordingly, an object of the invention is to provide an improved refrigerant gas injection system wherein the injection of the refrigerant gas is automatically stopped when the screw compressor is unloaded, thereby avoiding the abovedescribed problems of the prior art while fully utilizing the advantages of the economizer cycle.

To this end, according to the invention, a refrigerant gas injection system for a refrigeration cycle is provided including a screw compressor provided with a slide valve for controlling the compression capacity of the screw compressor, an economizer disposed in a passage for refrigerant liquid and adapted for subcooling the refrigerant liquid by the refrigerant of a reduced pressure, and a refrigerant gas injection line through which the refrigerant gas generated in the economizer is injected into the compression chamber of the screw compressor in its compression phase. A refrigerant gas injection system comprises a gas injection controlling means for enabling the injection of the refrigerant gas when the screw compressor is operating at full (100%) capacity or load level and stopping the gas injection when the screw compressor is operating in the unloaded state.

DESCRIPTION OF THE PREFERRED EMBODIMENTS

Figure 1:
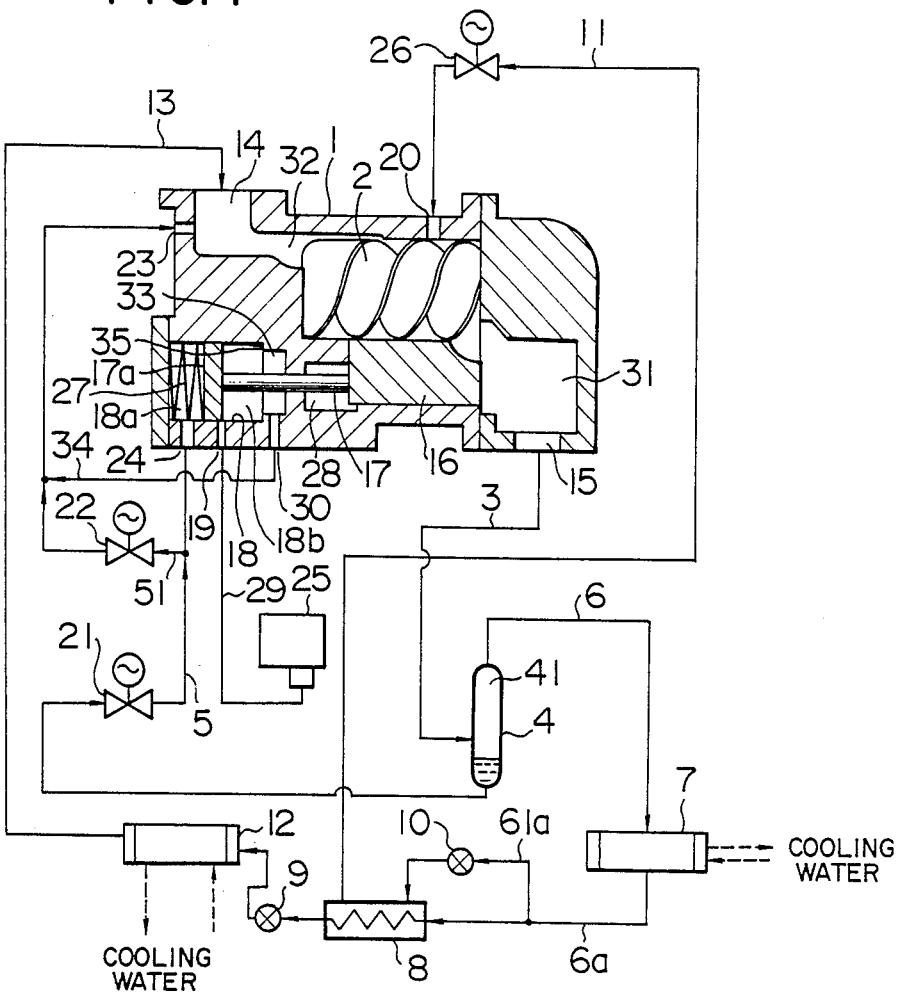
FIG. 1 is a block diagram of a refrigeration cycle incorporating an embodiment of a refrigerant gas injection system in accordance with the invention.
Figure 2:
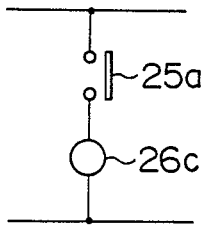
FIG. 2 is an electric wiring diagram.

Referring now to the drawings wherein like reference numerals are used throughout the various views to designate like parts and, more particularly, to FIG. 1, according to this figure, a refrigeration cycle incorporates a screw compressor having a casing 1 which rotatably accommodates a pair of screw rotors 2 one of which is drivingly connected to a driving motor (not shown). A discharge pipe 3 is connected to the casing 1 so as to communicate with a discharge chamber 31 through a discharge port 15. An oil separator 4 is connected to the discharge pipe 3. The upper space 41 in the oil separator 4 is communicated with the condenser 7 through a discharge gas pipe 6. A refrigerant liquid pipe **6*a* is connected at its one end to the refrigerant outlet of the condenser 7, while the other end is connected to a subcooling device 8 (referred to as an "economizer", hereinunder). A main expansion valve 9, as a pressure reducing means, is connected to the outlet side of the economizer 8. An auxiliary expansion valve 10 is connected to a branch pipe branching from the refrigerant liquid pipe 6*a*. The outlet of the auxiliary expansion valve 10 is connected to the economizer 8 so that the refrigerant expanded through the auxiliary expansion valve 10 subcools the refrigerant liquid which flows through the economizer 8. An evaporator 12 is connected at its inlet side to the main expansion valve 9 and at its outlet side to a suction chamber 32 of the screw compressor through the suction pipe 13 past the suction port 14**.

A gas introduction pipe 11 is connected at its one end to the outlet side of the economizer 8. The other end of the gas introduction pipe 11 leads to a gas injection port 20 formed in the casing 1 through a gas injection solenoid valve 26. The gas injection port 20 is so positioned that it can communicate with the compression chamber which is in its compression process. A slide valve 16, which constitutes an unloading means, is integrated with a piston **17*a* through a piston rod 17. The piston 17*a* is slidably received in a cylinder 18. The piston 17*a* is urged by a spring 27 so that the slide valve 16 is kept opened while a pressure balance is maintained in the screw compressor during operation thereof. Thus, the piston rod 17, piston 17*a*, spring 27 and the cylinder 18 in combination constitute an actuator for actuating the slide valve 16. The arrangement is such that, when the slide valve 16 is opened to unload the screw compressor, a part of the compressed refrigerant gas is relieved into a space 28** which leads to the low-pressure side of the compressor, whereby the amount of the gas finally compressed is decreased.

The space in the cylinder 18 is divided by the piston **17*a* into two sections: namely, a cylinder chamber 18*a* which is on the left side of the piston 17*a* as viewed in FIG. 1 and a back chamber 18*b* which is on the right side of the piston 17*a*. A capacity detecting hole 19 is formed in the wall of the cylinder 18 at a position where the piston 17*a* is located when the screw compressor is operating at 100% capacity or load. A pressure switch 25 is connected to the capacity detection hole 19 through a pressure detection pipe 29, so as to be opened and closed in response to a change in the pressure within the back chamber 18*b* within the cylinder. The pressure switch 25 is electrically connected to the gas injection solenoid valve 26 in series thereto. The arrangement in such, when the contact 25a of the pressure switch 25 makes contact, the solenoid coil 26c of the gas injection solenoid valve 26 is energized to open the solenoid valve 26**.

An oil supply port 24 is formed in the wall of the cylinder 18 in such a manner as to open to the cylinder 18a. An oil supply passage 5 leading from the oil well in the oil separator 4 and having an oil supply solenoid valve 21 is connected to the oil supply port 24. A branch oil passage 51 branches from a portion of the oil supply passage 5 between the oil supply port 24 and the oil supply solenoid valve 21. The branch oil pipe is communicated with a port 23 formed in the suction side of the casing 1 through a low-pressure equalizer valve 22. A port 30 is communicated with a chamber 33 which, in turn, is connected to the back chamber 18b. The port 30 is connected through an equalizer passage 34 to the oil branch passage 51 leading to the port 23 and, therefore, is always held in communication with the low-pressure side. A stopper portion 35 stops the piston 17a when the piston 17a as been fully moved to the right as viewed in FIG. 1, thus limiting the rightward displacement of the piston 17a.

The operation of the refrigeration cycle is as follows. The refrigerant gas sucked into the screw compressor, is compressed to a high pressure and temperature, and is introduced through the discharge pipe 3 into the oil separator 4 where the oil, suspended by the refrigerant gas, is separated from the oil. The separated oil is supplied through the oil supply pipe 5 to the portions of the screw compressor which need the lubrication.

On the other hand, the refrigerant gas, now free of the oil, is introduced into the condenser 7 through the discharge pipe 6. The refrigerant is then condensed into a liquid phase as a result of heat exchange with cooling water which is supplied to and discharged from the condenser 7 as indicated by broken-line arrows. The refrigerant liquid thus obtained is then introduced to the main expansion valve 9 through the economizer 8.

On the other hand, the refrigerant gas expanded through the auxiliary expansion valve 10 is made to flow through the economizer 8 so as to subcool the refrigerant liquid flowing therethrough and is returned to the compression chamber of the screw compressor in a compression process through the gas introduction pipe 11. Meanwhile, the refrigerant, expanded to lower pressure through the main expansion valve 9, is evaporated in the evaporator 12 through heat exchange with water which flows into and out of the evaporator 12 as indicated by broken-line arrows. The gaseous refrigerant of low pressure and temperature thus formed is then returned to the screw compressor through the suction pipe 13. The refrigerant is thus recirculated through the refrigeration cycle while changing its phase between the liquid and gaseous phases.

The advantage of the economizer cycle having the described construction resides in that the enthalpy possessed by the refrigerant and, hence, the refrigeration power of the refrigeration cycle is increased as the extent of subcooling effected in the economizer 8 is increased, and also the refrigerant gas expanded through the auxiliary expansion valve 10 and subcooled refrigerant liquid is returned to the compression chamber of the screw compressor in the compression phase so as to avoid reduction in the refrigeration power.

The control of the capacity of the screw compressor is conducted in the following manner. The level of the refrigeration load is detected through sensing the refrigerant pressure at the suction side of the compressor or the temperature of the cooling water at the outlet of the evaporator. In response to the load detection signal, the oil supply solenoid valve 21 is opened, while the low-pressure equalizer solenoid valve 22 is closed, respectively, so that a pressurized oil is supplied into the cylinder chamber 18a on the left side of the piston 17a. Consequently, the piston 17a is displaced to the right as viewed in FIG. 1 so as to unload the compressor thereby reducing the capacity of the screw compressor. Conversely, when the solenoid valves 21 and 22 are closed and opened, respectively, the oil is relieved from the cylinder chamber 18a so that the piston 17a is displaced to the left as viewed in FIG. 1 thereby, increasing the capacity. The amount of movement of the piston 17a is controlled by the opening times of the solenoid valves 21 and 22. The cylinder chamber 18a on the left side of the piston 17a is a high-pressure chamber, while the back chamber 18b on the right side of the same is a low-pressure chamber. Therefore, the capacity detection hole 19 is formed at such a position that the pressure therein is changed from the high pressure to the low pressure when the piston 17a is moved to the position corresponding to 100% load or capacity, as shown in FIG. 1.

This pressure change is detected and changed into an electric signal by the pressure switch 25. The gas injection solenoid valve 26 provided in the gas introduction pipe 11 is controlled in accordance with this electric signal. Namely, when the screw compressor is operating at 100% capacity or load level, it turns the gas injection solenoid valve 26 on thereby activating the economizer cycle, whereby the refrigerant gas from the economizer 8 is introduced to the gas injection port 20 and injected into the compression chamber of the screw compressor. However, when the screw compressor is operating at the other load level, i.e., in the unloaded state, the gas injection solenoid valve 26 is turned off to stop the injection of the refrigerant gas.

As will be understood from the foregoing description, according to the invention, the injection of the gas to the suction side is automatically stopped when the screw compressor is unloaded, so that the advantage of the economizer can be fully utilized without the risk of introduction of the refrigerant to the low pressure side. In the described embodiment, the 100% capacity or load level is detected by sensing a change in the pressure. This detection system enables the invention to be applied easily to a refrigeration system employing a compressor such as a hermetic screw compressor with which it is generally difficult to find a change in the capacity or load level.

Figure 3:
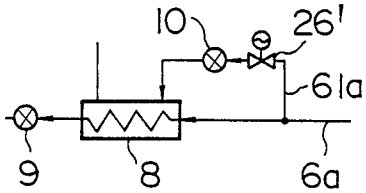
FIG. 3 is a block diagram of a refrigeration cycle incorporating another embodiment of the refrigerant gas injection system.

FIG. 3 shows a modification in which the gas injection solenoid valve 26' for introducing the refrigerant gas is disposed in a pipe 61a which is upstream of the auxiliary expansion valve 10. It will be clear that this modification produces the same advantage as that produced in the embodiment shown in FIG. 1.

The capacity control by the slide valve can be broadly sorted into two types: namely, stepped type control and linear type control. The embodiment described hereinbefore employs the linear type control with which it is generally difficult to detect the 100% capacity operation of the compressor.

Another embodiment of the invention in which the compressor employs the stepped type control will be described hereinunder with reference to FIG. 4.

Figure 4:
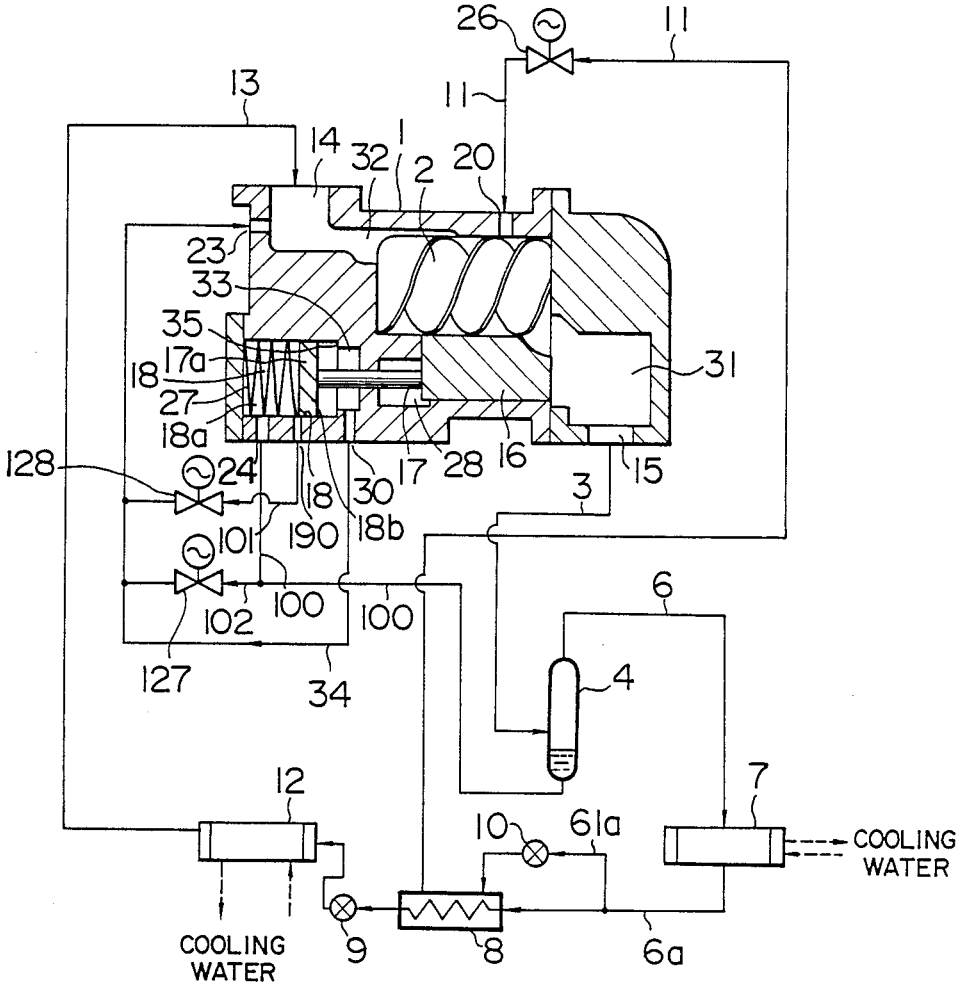
FIG. 4 is a block diagram of a refrigeration cycle incorporating still another embodiment of the refrigerant gas injection system.

The embodiment of FIG. 4 employs an oil supply passage 100 which is connected at its one end to the oil reservoir of the oil separator 4, while the other end is connected to the oil supply port 24 of the casing 1. An oil supply solenoid valve 127 provided in an oil passage 102 is controlled in such a manner as to open when the compressor is operating at 100% capacity or load level, while an unloading solenoid valve 128 provided in an unloading oil passage 101 is controlled in such a manner as to open when the load capacity is about 50%. A port 190 is formed at a position corresponding to the 50% capacity operation. When the screw compressor is operating at 100% load level, the oil supply solenoid valve 127 is opened so as to relieve the oil to the low-pressure side. At the same time, the unload solenoid valve 128 is closed and the gas injection solenoid valve 26 in the gas introduction pipe 11 is opened. In contrast, when the screw compressor is operating at 50% capacity or load level, the oil supply valve 127 is closed to cause a movement of the piston 17*a* so as to open the slide valve 16, while opening the unload solenoid valve 128, thereby relieving a part of the oil to the low-pressure side. Consequently, the piston 17*a* is stably held at the position near the hole 190, so that the compressor stably operates in the unloaded state. The gas injection solenoid valve 26 is controlled in relation to the control of the solenoid valves 127, 128 so as to be closed during the unloaded operation of the screw compressor. With this arrangement, the capacity of the screw compressor is controlled in a stepped manner such that the compressor operates either at the full (100%) capacity or in unloaded state, i.e., at 50% capacity, and the economizer cycle operates only when the screw compressor is operating at the full (100%) capacity.

In the embodiments of FIGS. 1 and 3 described hereinabove, the detection means for detecting the change in the pressure in the actuator for actuating the slide valve is constituted by the capacity detection hole 19 formed in the wall of the cylinder 18 and the pressure switch 25. This, however, is not exclusive and the change in the pressure can be detected by the other suitable means such as an external mechanical contact means which operates externally of the compressor in response to the movement of the piston 17*a*.

As has been described, according to the invention, it is possible to automatically stop the injection of the refrigerant gas and, hence, the undesirable introduction of the refrigerant gas into the suction side of the compressor, when the screw compressor operates in unloaded conditions.

It is thus possible to fully employ the merits of the economizer cycle, without being accompanied by various problems which would otherwise be caused by the introduction of the refrigerant liquid into the suction side of the compressor.

What is claimed is:

1. In a refrigeration cycle having a screw compressor provided with a slide valve means for controlling a compression capacity of said screw compressor, an economizer means disposed in a refrigerant liquid passage for subcooling said refrigerant liquid by the refrigerant of a reduced pressure, and a refrigerant gas injection line through which the refrigerant gas generated in said economizer means is injected into the compression chamber of said screw compressor in a compression phase, a refrigerant gas injection system comprising:

an oil supplying means adapted to supply a pressurized oil to an actuator for actuating said slide valve, only when said screw compressor is operating in an unloaded state; and a gas injection solenoid valve disposed in said refrigerant gas injection line and adapted for operating in relation to an operation of said oil supplying means in such a manner so as to open when said screw compressor is operating at a full load level and to close when the screw compressor is operating in the unloaded state.

2. In a refrigeration cycle including a screw compressor provided with a slide valve means for controlling a compression capacity of said screw compressor, an economizer means disposed in a refrigerant liquid passage for subcooling said refrigerant liquid by the refrigerant of a reduced pressure, and a refrigerant gas injection line through which the refrigerant gas generated in said economizer means is injected into the compression chamber of said screw compressor in a compression phase of the screw compressor, a refrigerant gas injection system comprising:

a pressure switch operative in response to the pressure in a cylinder forming an actuator for actuating said slide valve means;

a gas injection solenoid valve provided in said refrigerant gas injection line and adapted to be opened and closed in response to an output signal from said pressure switch;

an oil supply passage means for supplying pressurized oil into a cylinder chamber defined on a top of a piston disposed in said cylinder;

an oil supply solenoid valve disposed in said oil supply passage, said oil supply solenoid valve being adapted to close said oil supply passage means when said screw compressor is operating at a full capacity or at a load level and to open said oil supply passage when said screw compressor is operating in an unloaded state;

an oil passage means through which said cylinder chamber on a top of said piston is communicated with a suction side of said screw compressor;

a low-pressure equalizer solenoid valve provided in said oil passage and adapted to be respectively closed and opened when said oil supply solenoid valve is opened and closed; and an equalizer passage through which a back chamber on an opposite side of said piston to said cylinder chamber is communicated with the suction side of said screw compressor.

3. A refrigerant gas injection system according to claim 2, wherein said gas injection solenoid valve is disposed on the inlet side of said economizer means.

4. In a refrigeration cycle having a screw compressor provided with a slide valve means for controlling a compression capacity of said screw compressor, an economizer means disposed in a refrigerant liquid passage for subcooling said refrigerant liquid by the refrigerant of a reduced pressure, and a refrigerant gas injection line through which the refrigerant gas generated in said economizer means is injected into the compression chamber of said screw compressor in a compression phase, a refrigerant gas injection system comprising:

an oily supply passage means for supplying pressurized oil into a cylinder chamber defined on a top of a piston in a cylinder forming an actuator for actuating said slide valve;

an oil passage means for providing a communication between said oil supply passage means and a suction side of said screw compressor;

an oil supply solenoid valve disposed in said oil passage means, said oil supply solenoid valve being adapted to open said oil passage means when said screw compressor is operating at full capacity or at a load level and to close said oil passage means when said screw compressor is operating in an unloaded state;

an unloading oil passage means for providing a communication between a interior of said cylinder substantially at a mid point of a stroke of said piston and the suction side of said screw compressor;

an unload solenoid valve disposed in said unloading oil passage and adapted to be respectively closed and opened when said oil supply solenoid valve is opened and closed;

an equalizer passage means through which a back chamber on an opposite side of said piston to said cylinder chamber is communicated with the suction side of said screw compressor; and a gas injection solenoid valve disposed in said refrigerant gas injection line and adapted for operating in relation to an operation of an oil supply means for supplying the pressurized oil in such a manner so as to open when said screw compressor is operating at a full load level and to close when the screw compressor is operating in the unloaded state.

5. A refrigerant gas injection system according to claim 4, wherein said gas injection solenoid valve is disposed on an inlet side of said economizer means.

* * * * *